US010478000B2

(12) United States Patent
Choi et al.

(10) Patent No.: US 10,478,000 B2
(45) Date of Patent: Nov. 19, 2019

(54) INSULATED CUP WITH DOUBLE WALL CONSTRUCTION

(71) Applicant: SEUNG HWA PNP CO., LTD., Gwangju-si (KR)

(72) Inventors: Ji Yoon Choi, Seoul (KR); Seo Young Choi, Seoul (KR)

( * ) Notice: Subject to any disclaimer, the term of this patent is extended or adjusted under 35 U.S.C. 154(b) by 0 days.

(21) Appl. No.: 15/765,478

(22) PCT Filed: Sep. 26, 2017

(86) PCT No.: PCT/KR2017/010651
§ 371 (c)(1),
(2) Date: Apr. 2, 2018

(87) PCT Pub. No.: WO2018/066866
PCT Pub. Date: Apr. 12, 2018

(65) Prior Publication Data

US 2019/0216245 A1 Jul. 18, 2019

(30) Foreign Application Priority Data

Oct. 7, 2016 (KR) ..... 10-2016-0129749
Dec. 8, 2016 (KR) ..... 10-2016-0166513

(51) Int. Cl.
*B65D 81/38* (2006.01)
*A47G 23/02* (2006.01)
(Continued)

(52) U.S. Cl.
CPC ..... *A47G 23/0216* (2013.01); *A47G 19/2288* (2013.01); *B65D 25/34* (2013.01);
(Continued)

(58) Field of Classification Search
CPC ..... A47G 23/0216; A47G 23/0208; A47G 19/2288; A47G 19/23; A47G 2023/0283;
(Continued)

(56) References Cited

U.S. PATENT DOCUMENTS 4,040,537 A * 8/1977 Edwards ..... B65D 1/265 206/520
2006/0118608 A1* 6/2006 Stahlecker ..... B31F 1/0038 229/403
(Continued)

FOREIGN PATENT DOCUMENTS

JP 3953992 8/2007
KR 10-2001-0077172 8/2001
(Continued)

OTHER PUBLICATIONS

English Specification of 10-2001-0077172.
(Continued)

*Primary Examiner* — Stephen J Castellano
(74) *Attorney, Agent, or Firm* — Antonio HA & U.S. Patent, LLC

(57) ABSTRACT

A cup is disclosed. The cup includes: a cup body made of synthetic resin and having a containing part with an opening having a relatively large diameter to be able to receive a beverage or food; and a cup holder fitted on the cup body from the opposite end to the opening to be fixed on the outer side under the opening of the cup body. The upper end of the cup holder is fitted on a holder top seat on the outer side of the opening of the cup body and the lower end of the cup holder is in contact with the outer side of the lower portion of the cup body at a position such that the portion except for the upper and lower ends of the cup holder is spaced a distance from the outer side of the containing part of the cup body.

3 Claims, 13 Drawing Sheets

(51) Int. Cl.
*A47G 19/22* (2006.01)
*B65D 25/34* (2006.01)

(52) U.S. Cl.
CPC ..... *B65D 81/38* (2013.01); *B65D 81/3869* (2013.01); *A47G 2400/12* (2013.01)

(58) Field of Classification Search
CPC ..... A47G 2023/0275; B65D 21/0233; B65D 81/3881; B65D 81/3876; B65D 81/3865; B65D 81/3869; B65D 25/34
See application file for complete search history.

(56) References Cited

U.S. PATENT DOCUMENTS

2008/0078825 A1* 4/2008 Puls ..... B65D 81/3869 229/403
2008/0087715 A1* 4/2008 Robertson ..... B65D 81/3869 229/403
2011/0174656 A1* 7/2011 D'Amato ..... B31F 1/0038 206/505
2013/0001286 A1* 1/2013 Stahlecker ..... B65D 3/06 229/400

FOREIGN PATENT DOCUMENTS

KR 10-1198092 11/2012
KR 10-1200292 11/2012

OTHER PUBLICATIONS

English Specification of 10-1200292.
English Abstract of 3953992.
English Specification of 10-1198092.

* cited by examiner

INSULATED CUP WITH DOUBLE WALL CONSTRUCTION

This application is the national stage (Rule 371) of international application No. PCT/KR2017/010651 filed Sep. 26, 2017.

TECHNICAL FIELD

The present invention relates to a cup that a user can conveniently hold regardless of whether the substance is contained therein is cold or hot.

In detail, the present invention relates to a cup that can be easily formed and can be more firmly assembled because the upper portion of a cup holder does not spread from a cup body. Further, the present invention relates to a cup that does not become hot or cold even if it is continuously used for a long time because heat is discharged through the lower portion.

BACKGROUND ART

In general, when people unconsciously hold a container with a very hot substance such as coffee or ramyon, they may drop the container because the container is hot. Alternatively, it is difficult to hold very cold containers with one hand, so napkins, corrugated cardboards, or empty cups over the container are used, which is disadvantageous in terms of the manufacturing cost, reduction of wastes, and in terms of saving.

In order to solve these problems, a "Disposable Cup and Container" has been disclosed in Korean Patent Application Publication No. 10-2001-0077172.

Protrusions are formed at the portion of a cup or a container to be held with a hand to prevent heat from directly conducting from the substance in the cup or container to the portion to be held so that a user can hold the cup or container easily and long by hand regardless of the temperature of the substance.

However, since the protrusions are in contact with the outer side of a cup on its inner side, heat can transfer when the cup is used for a long time, and it is difficult to form the protrusions when manufacturing the cup, so the cup did not come into the market.

Korean Patent Application Publication No. 10-2001-0077172 (titled "Disposable Cup and Container")

DISCLOSURE

Technical Problem

The present invention has been made in an effort to solve the problems and a cup and a holder are combined, so the cup can be easily formed by a simple mold. An object of the present invention is to provide a cup that prevents a user from feeling coldness or heat from a beverage in a cup body when drinking a cold or hot beverage by fitting a cup holder close to an opening of the cup body.

Another object of the present invention is to provide a cup in which the upper portion of a cup holder is fitted on a holder top seat and the lower portion of the cup holder is seated in a cup holder bottom seat so that the cup holder is firmly fitted on the upper portion of the cup body.

Another object of the present invention is to provide a cup in which a containing part is inclined such that the diameter decreases downward, but a holder top seat and a vertical inner wall portion are vertically formed, so the upper portion of the cup holder can be firmly fixed without spreading when the cup holder is fitted on the cup body.

Another object of the present invention is to provide a cup in which air holes are formed at a bottom seating protrusion of a cup holder so that external air flows between the outer side of a containing part of a cup body and a grip of the cup holder, and coldness or heat transferring to the outer side of the containing part is discharged downward from the cup boy and the cup holder through the air holes, so transfer of coldness and heat to the cup holder is delayed, whereby a user can easily drink a beverage even if he/she holds the cup for a long time.

Another object of the present invention is to provide a cup in which an inclined fastening groove having a diameter decreasing upward is formed on the outer side of a holder stop seat; the upper portion of the cup holder has an inclined fitting portion formed such that a diameter of an inner side of the cup holder decreases upward to correspond to the inclined fastening groove; and the lower portion of the cup holder is supported with regular angular intervals on the lower portion of the cup body, so when the cup holder is fitted on the upper portion of the cup body, the cup holder is not easily separated from the cup body, thus the cup can be easily used. Further, immediately after a user puts a hot beverage into the containing part of the cup body, heat slowly transfers because a grip between both ends of the cup holder is not in direct contact with the containing part of the cup body, so the user can easily drink a very cold or hot beverage with the cup in his/her hand and the lower portion of the cup can be easily formed.

Another object of the present invention is to provide a cup in which anti-sticking protrusions are formed with regular angular intervals at a predetermined position on the inner side of a cup body, so a loss of material when the anti-sticking protrusions are formed at predetermined positions with regular angular intervals around the inner side of the containing part is smaller than that when the anti-sticking protrusions are formed around the entire inner side with the outer side of the cup body maintained at a predetermined angle during forming of the cup body, and accordingly, the manufacturing cost is reduced and the cup can be easily formed because contraction does not occur during forming.

Another object of the present invention is to provide a cup in which a cup holder bottom seat is formed such that the thickness of a cup body is little changed, so the cup body does not contract during forming and the product can be very easily manufactured.

Technical Solution

A cup of the present invention includes: a cup body made of synthetic resin and having a containing part with an opening being open upward and having a relatively large diameter to be able to receive a beverage or food; and a cup holder fitted on the cup body from the opposite end to the opening to be fixed on the outer side under the opening of the cup body. The upper end of the cup holder is fitted on the outer side of a holder top seat formed close to the opening of the cup body and the lower end of the cup holder is in close contact with the outer side of the lower portion of the cup body at a predetermined position such that the portion except for the upper end and the lower end of the cup holder is spaced a predetermined distance from the outer side of the containing part of the cup body.

An inclined fastening groove of which the diameter decreases upward is formed on the outer side of the holder top seat formed on the cup body and an inclined fitting portion is formed at an upper portion of the cup holder such that a diameter of an inner side of the cup holder decreases upward, to correspond to the inclined fastening groove.

The cup body has a holder top seat extending a predetermined length under the opening, and a containing part-inclined surface inclined downward from the holder top set and stepped such that the diameter decreases to form a containing part; and the cup holder has a pipe-shaped grip having a predetermined length and being inclined such that the diameter decreases downward, and a bottom seating protrusion protruding inward at the lower end of the grip to be in close contact with the lower portion of the cup body.

Air holes are formed at the bottom seating protrusion so that external air flows between the outer side of the containing part and the grip of the cup holder.

Anti-sticking protrusions are further formed at a predetermined position on the containing part-inclined surface to support the bottom of a cup holder fitted in the containing part.

A cup holder bottom seat is recessed inward at a predetermined position on the containing part-inclined surface such that the lower portion of the cup holder is seated in close contact with the cup holder bottom seat.

Advantageous Effects

According to the cup of the present invention, since a cup and a holder are combined, the cup can be easily formed by a simple mold. Further, it is possible to prevent a user from feeling coldness or heat from a beverage in a cup body when drinking a cold or hot beverage by fitting a cup holder close to an opening of the cup body.

According to the cup of the present invention, since the upper portion of a cup holder is fitted on a holder top seat and the lower portion of the cup holder is seated in a cup holder bottom seat, immediately after a user puts a hot beverage into the containing part of the cup body, heat slowly transfers because a grip between both ends of the cup holder is not in direct contact with the containing part of the cup body, so the user can easily drink a very cold or hot beverage with the cup in his/her hand.

According to the cup of the present invention, a containing part is inclined such that the diameter decreases downward, but a holder top seat and a vertical inner wall portion are vertically formed, so the upper portion of the cup holder can be firmly fixed without spreading when the cup holder is fitted on the cup body.

According to the cup of the present invention, air holes are formed at a bottom seating protrusion of a cup holder so that external air flows between the outer side of a containing part of a cup body and a grip of the cup holder, and coldness or heat transferring to the outer side of the containing part is discharged downward from the cup body and the cup holder through the air holes, so transfer of coldness and heat to the cup holder is delayed, whereby a user can easily drink a beverage even if he/she holds the cup for a long time.

According to the cup of the present invention, an inclined fastening groove having a diameter decreasing upward is formed on the outer side of a holder stop seat; the upper portion of the cup holder has an inclined fitting portion formed at an upper portion of the cup holder such that a diameter of an inner side of the cup holder decreases upward; and the lower portion of the cup holder is supported with regular angular intervals on the lower portion of the cup body, so when the cup holder is fitted on the upper portion of the cup body, the cup holder is not easily separated from the cup body, thus the cup can be easily used. Further, when a user puts a hot beverage into the containing part of the cup body, heat slowly transfers because a grip between both ends of the cup holder is not in direct contact with the containing part of the cup body, so the user can easily drink a very cold or hot beverage with the cup in his/her hand and the lower portion of the cup can be easily formed.

According to the cup of the present invention, anti-sticking protrusions are formed with regular angular intervals at a predetermined position on the inner side of a cup body, so a loss of material when the anti-sticking protrusions are formed at predetermined positions with regular angular intervals around the inner side of the containing part is smaller than that when the anti-sticking protrusions are formed around the entire inner side with the outer side of the cup body maintained at a predetermined angle during forming of the cup body, and accordingly, the manufacturing cost is reduced and the cup can be easily formed because contraction does not occur during forming.

According to the cup of the present invention, a cup holder bottom seat is formed such that the thickness of a cup body is little changed, so the cup body does not contract during forming and the product can be very easily manufactured.

MODE FOR INVENTION

Figure 1:
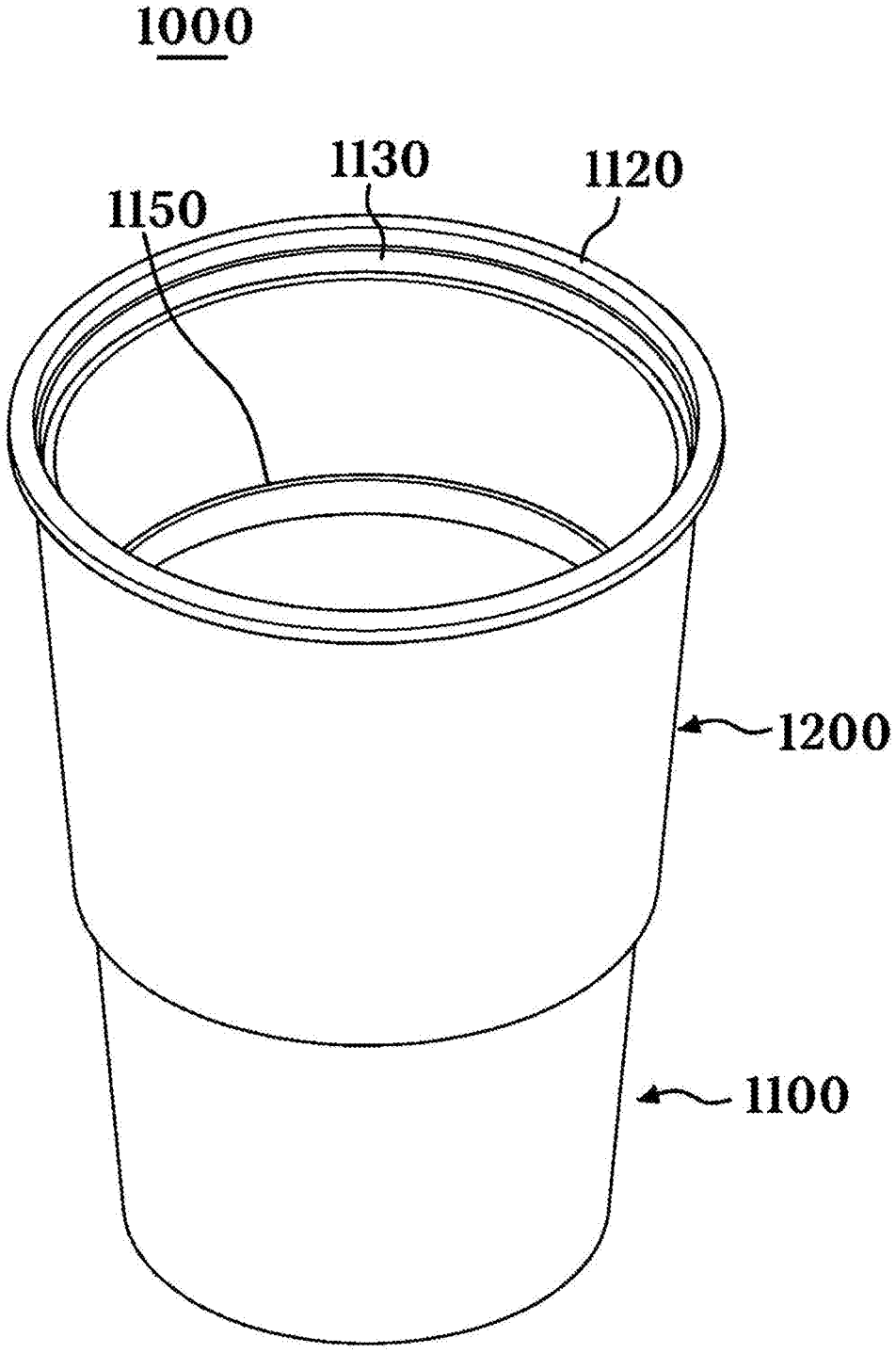
FIG. 1 is a perspective view showing a cup according to a first embodiment of the present invention.
Figure 2:
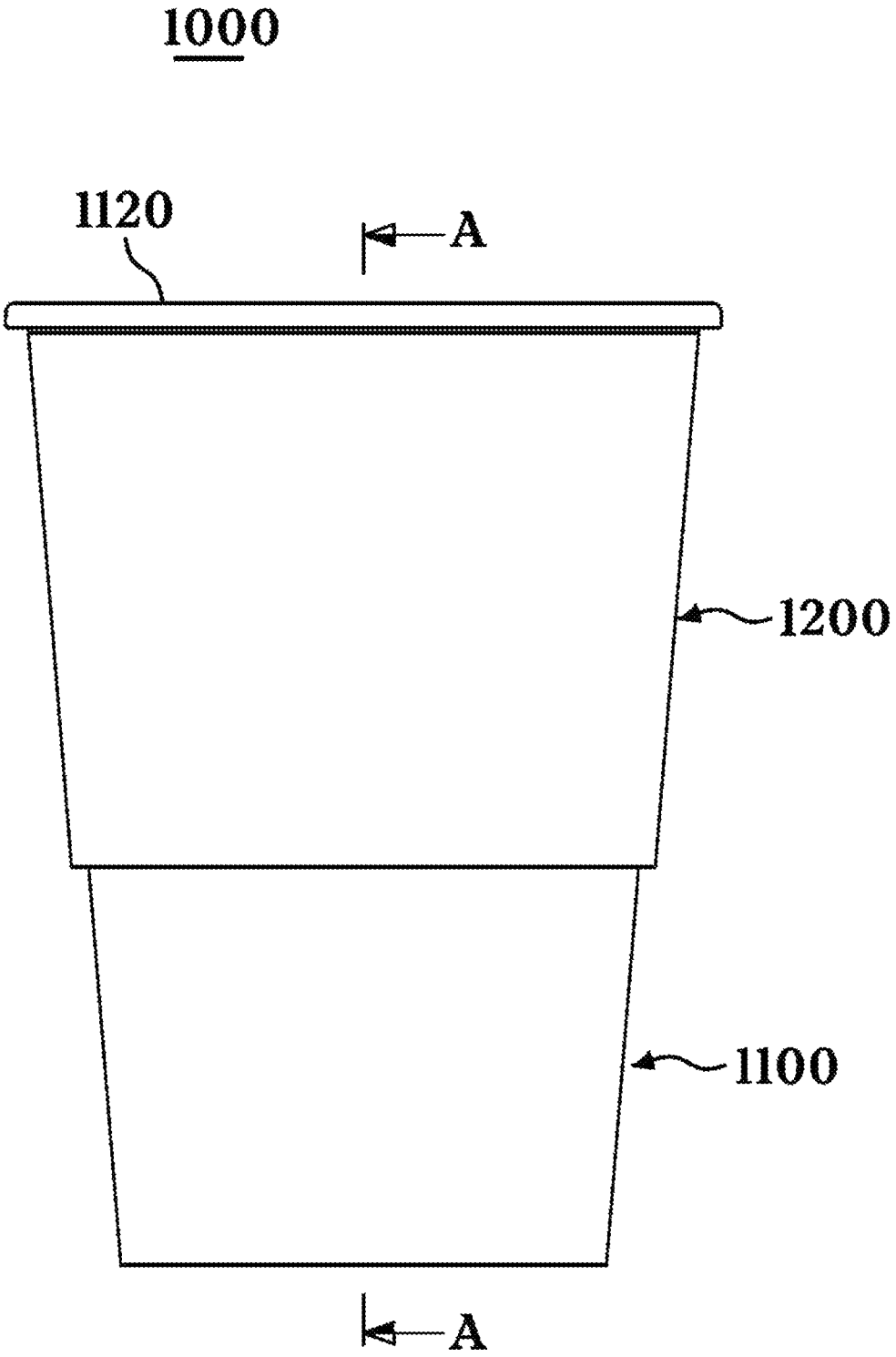
FIG. 2 is a front view of FIG. 1.

Hereinafter, cups according to embodiments of the present invention will be described with reference to accompanying drawings.

When reference numerals are given to the components in the drawings, the same components are given the same reference numerals even though they are shown in different drawings. When function and configurations of components well known in the art may make the gist of the present invention unclear, a detailed description of the components will be omitted. Directional terms such as 'upper', 'lower', 'front', 'rear', 'front end', 'forward', and 'rear end' are used in association with the arrangement of the drawings.

Since components of embodiments of the present invention may be positioned in various directions, the directional terms are used as examples and do not limit the present invention.

A cup 1000 according to a first embodiment of the present invention, as shown in FIGS. 1 to 7, includes a cup body 1100 made of synthetic resin and having a containing part with an opening 1120 being open upward and having a relatively large diameter to be able to receive a beverage or food.

A cup holder 1200 is fitted on the cup body 1100 from the opposite end to the opening 1120 with the upper end thereof fitted on the opening 1120 of the cup body 1100 and the lower end fixed at a predetermined position on the outer side of the cup body 1100. Further, the other portion except for both ends of the cup holder 1200 is spaced a predetermine distance from the outer side of the cup body.

Accordingly, the cup body 1100 and the cup holder 1200 of the cup 1000 are manufactured by injection molding that uses simple molds. After being manufactured, the cup holder 1200 is fitted upward, that is, from the small-diameter portion of the cup body 1100 over the cup body 1100 from under and is pushed upward to be fitted onto the outer side of the portion where the opening 1120 of the cup body 1100 is formed.

Since the grip of the cup holder 1200 is spaced from the cup body 1100, when a user drinks a cold or hot beverage, transfer of the heat or coldness of the beverage in the cup body 1100 to the hand of the user is delayed by the cup holder 1200.

The main components of the first embodiment of the present invention are described in more detail. The cup body 1100 of the cup 1000 has the containing part with the opening 1120 being open upward and having a relatively large diameter to be able to receive a beverage or food.

Figure 7:
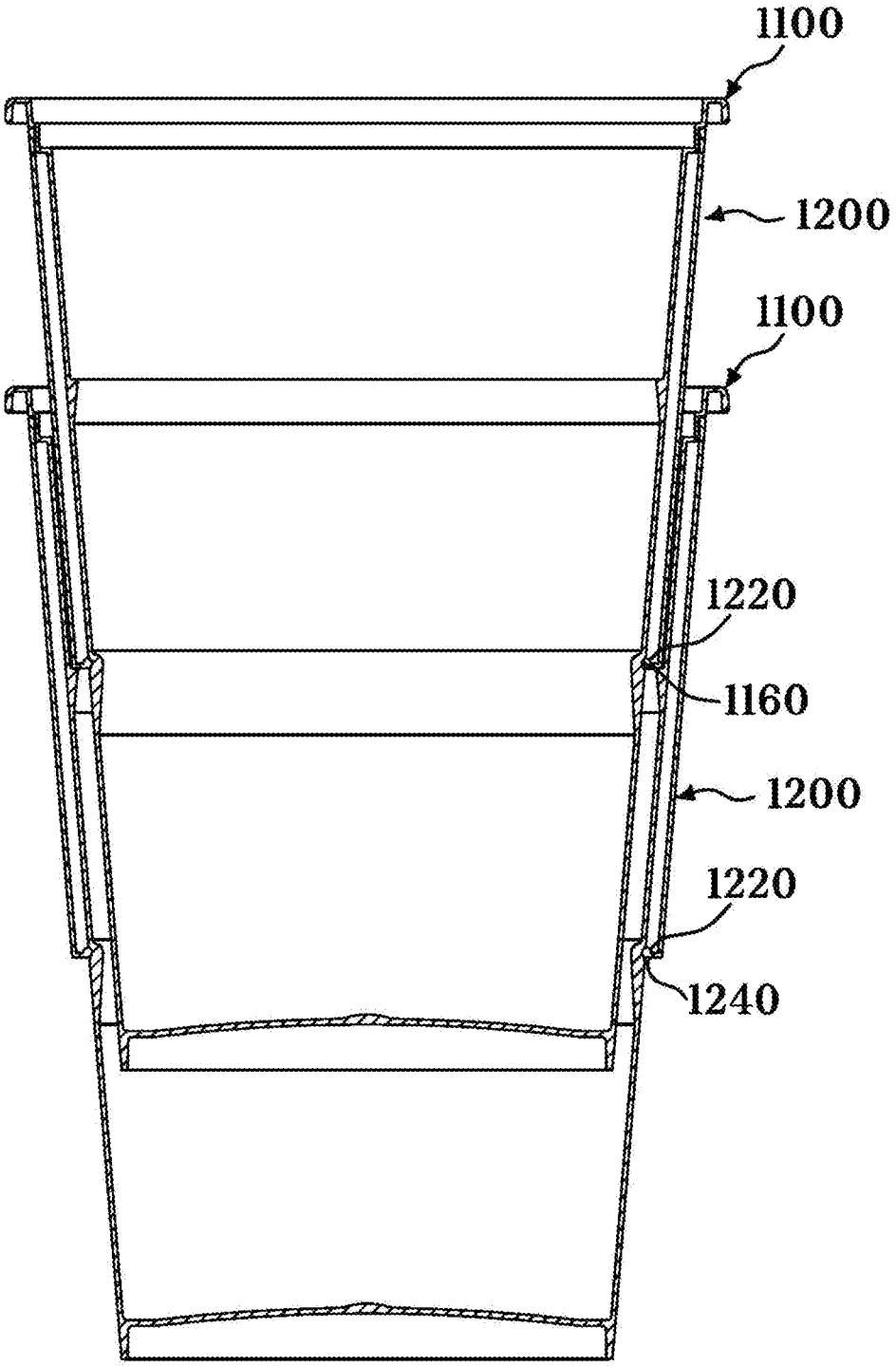
FIG. 7 is a vertical cross-sectional view showing the layered state of the cup of FIG. 1.

The cup body 1100 has a holder top seat 1130 extending downward a predetermined length from the opening 1120 and stepped inward and a containing part-inclined surface 1140 extending downward from the holder top seat 1130 to form the containing part 1100. An anti-sticking protrusion 1150 is formed at a predetermined position around the entire inner side of the containing part-inclined surface 1140 and protruding a predetermined distance to support the bottom of another cup holder on another cup body inserted in the assembly of the cup body 1100 and the cup holder 1200, as shown in FIG. 7.

A cup holder bottom seat 1160 recessed inward is formed at a predetermined distance downward from the anti-sticking protrusion 1150 on the outer side of the containing part-inclined surface 1140 to hold the bottom of the cup holder 1200.

Accordingly, when the cup holder 1200 is fitted upward from the bottom edge of the containing part 1110, the top of the cup holder 1200 is fitted into the holder top seat 1130 and the bottom of the cup holder 1200 is fitted into the cup holder bottom seat 1160.

Accordingly, since the grip spaced from both ends of the cup holder 1200 is not in direct contact with the containing part 1110 of the cup body 1100, when the containing part 1110 of the cup body 1100 is filled with a hot beverage, heat transfer progresses very slowly, so a user can easily drink a very hot or cold beverage with the cup 1000 in hand.

The cup holder 1200 has a pipe-shaped grip 1210 having a predetermined length and being inclined such that the diameter decreases downward, and a bottom seating protrusion 1220 protruding inward from the lower end of the grip 1210 to be fitted in the cup holder bottom seat 1160 of the cup body 1100.

A vertical inner wall portion 1230 is formed around the inner side of the upper end of the grip 1210 of the cup holder 1200 to be fitted on the outer side of the holder top seat 1130 of the cup body.

Accordingly, the bottom seating protrusion 1220 and the vertical inner wall portion 1230 of the cup holder 1200 are seated on the cup holder bottom seat 1160 and the holder top seat 1130 of the cup body 1100, whereby the cup holder 1200 is combined with the cup body 1100.

Therefore, since the grip 1210 of the cup holder 1200 is not in direct contact with the containing part of the cup body 1100, a user can hold the cup 1000 even immediately after putting a hot beverage into the containing part 1110.

According to this configuration, in the cup 1000, the cup body 1100 and the cup holder 1200 are integrally combined, so a user can very conveniently use the cup.

Although the containing part of the cup is formed such that the diameter decreases downward, the holder top seat 1130 of the cup and the vertical inner wall portion 1230 of the cup holder are vertically formed, so when the cup holder 1200 is fitted on the cup member 1100, the upper portion of the cup holder 120 can be firmly fixed without opening.

Air holes 1240 may be formed at the bottom seating protrusion 1220 of the cup holder 1200 so that external air can flow between the outer side of the containing part of the cup body 1100 and the grip 1210 of the cup holder 1200.

Accordingly, coldness or heat that transfers to the outer side of the containing part 1110, depending on the beverage in the cup body 1100, is discharged downward from the cup body 1100 and the cup holder 1200 by the air holes 1240, so even if a user keeps holding the cup 1000, transfer of the coldness and heat to the cup holder 1200 is delayed and the user can easily drink the beverage.

The cup holder bottom seat 1160 of the cup body and the bottom seating protrusion 1220 of the cup holder are formed in semicircular shape in this embodiment, but they may be formed in various shapes such as a triangle or a rectangle.

A film sheet with a printing surface may be thermally bonded to the outer sides of the cup body 1100 and the cup holder 1200.

Figure 8:
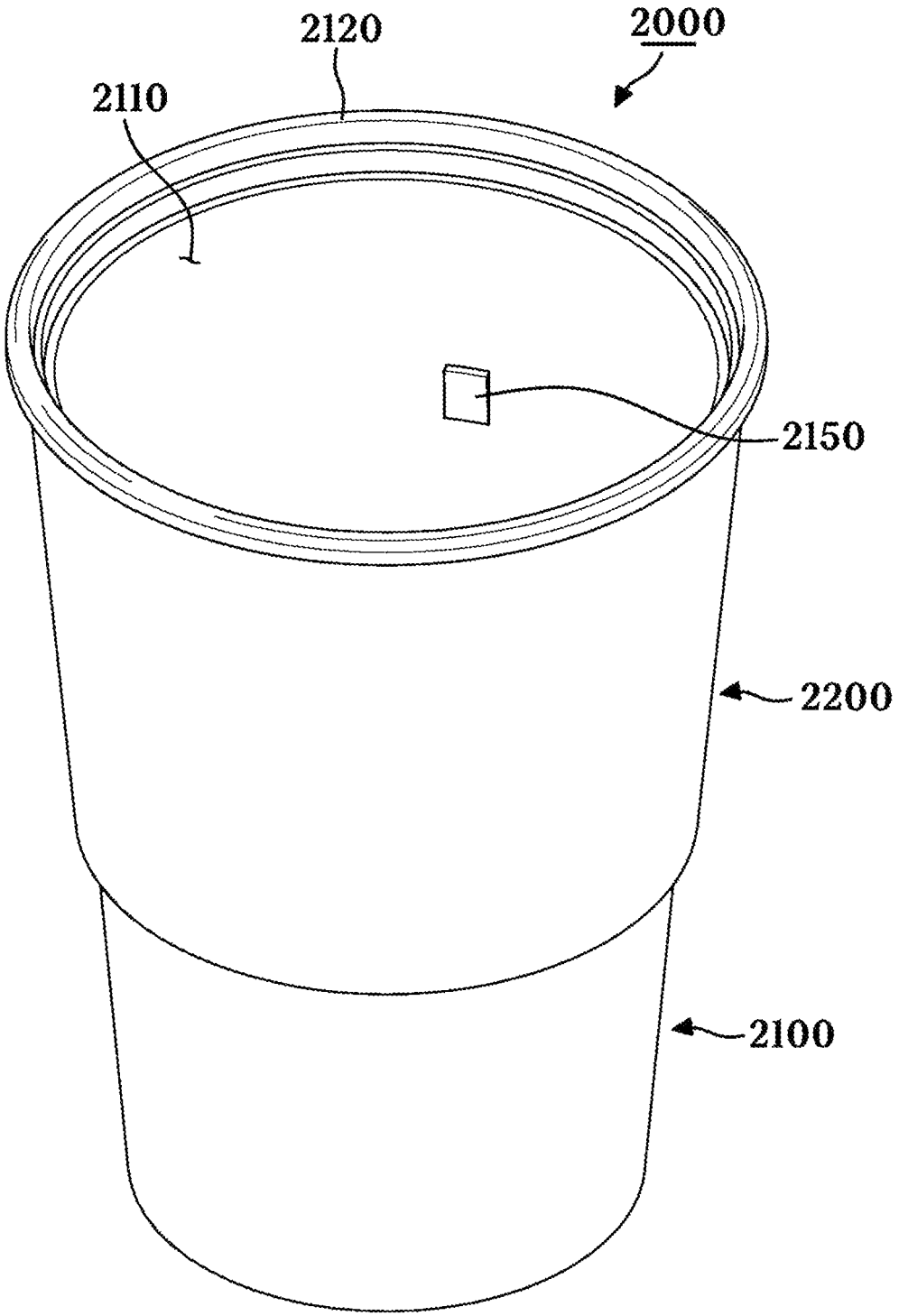
FIG. 8 is a perspective view showing a cup according to a second embodiment of the present invention.
Figure 9:
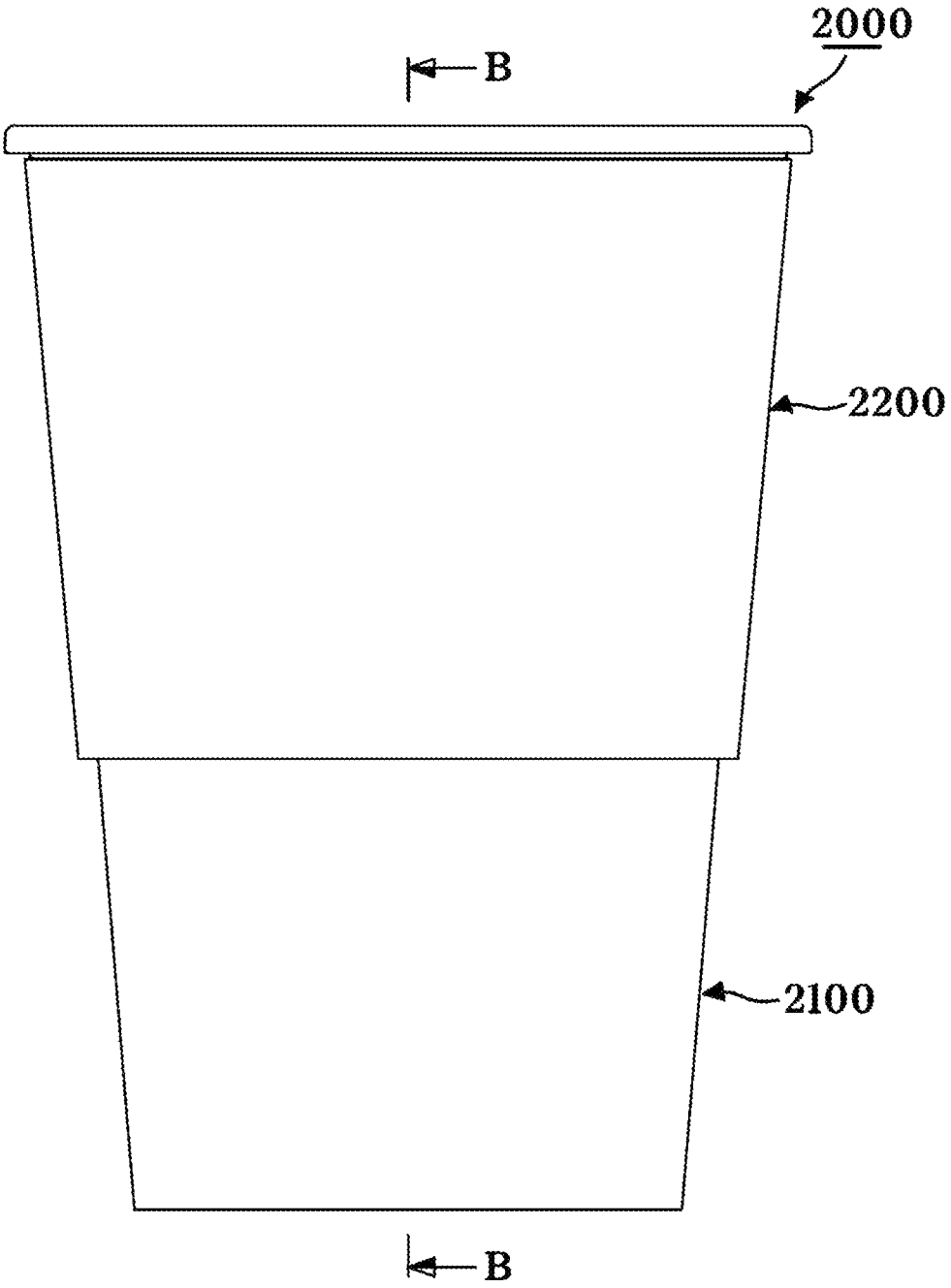
FIG. 9 is a front view of FIG. 8.
Figure 10:
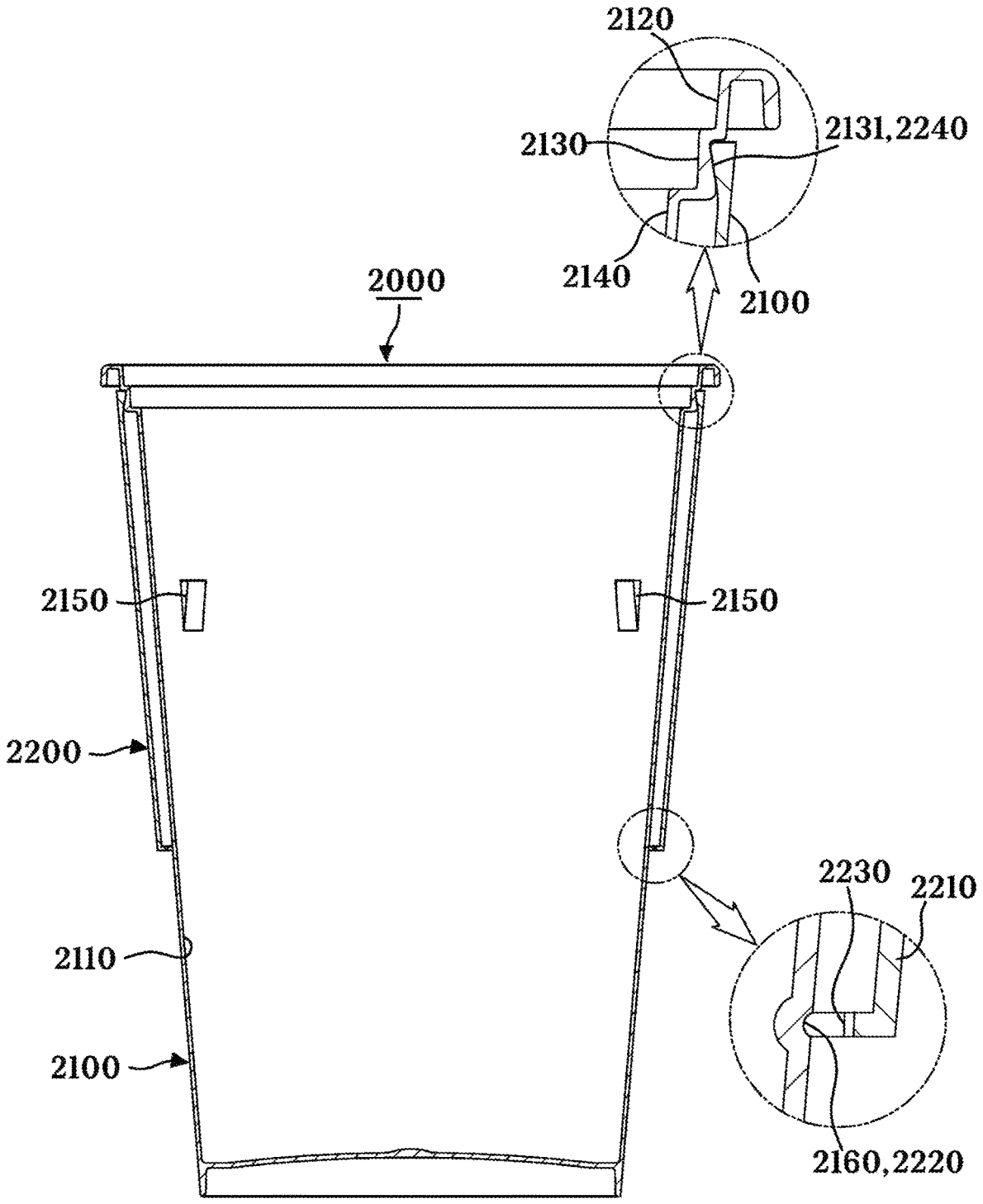
FIG. 10 is a cross-sectional view taken along line B-B of FIG. 9.

A cup 2000 according to a second embodiment of the present invention is shown in FIGS. 8 to 10.

The cup 2000 includes a cup body 2100 made of synthetic resin and having a containing part 2110 with an opening 2120 being open upward and having a relatively large diameter to be able to receive a beverage or food.

A cup holder 2200 is fitted on the cup body 2100 from the opposite end to the opening 2120 with the upper end thereof fitted on the portion under the opening 2120 of the cup body 2100 and the lower end fixed at a predetermined position on the outer side of the cup body 1100. Further, the other portion except for both ends of the cup holder 2200 is spaced a predetermined distance from the outer side of the cup body.

The subject of the second embodiment of the present invention is described in more detail. A holder top seat 2130 is formed on the outer side of the opening 2120 of the cup body 2100 such that the upper portion of the cup holder 2200 is fitted thereon and an inclined fastening groove 2131 is formed on the holder top seat 2130 such that the diameter decreases upward.

An inclined fitting portion 2240 is formed at the upper portion of the cup holder 2200 such that the diameter of the inner side of the cup holder decreases upward, to correspond to the inclined fastening groove 2131.

Accordingly, when the cup holder 2200 having the inclined fitting portion 2240 is fitted on the cup body 2100 having the inclined fastening groove 2131, the inclined fitting portion 2240 is seated in the inclined fastening groove 2131.

After assembly, the cup holder 2200 is not easily separated from the cup body 2100, so a user can easily use the cup.

Anti-sticking protrusions 2150 are formed at predetermined positions around the inner side of the cup body 2100 with regular angular intervals of 120 degrees, as shown in FIGS. 8 to 10.

Accordingly, the anti-sticking protrusions 2150 are formed with regular angular intervals of 120 degrees.

Figure 3:
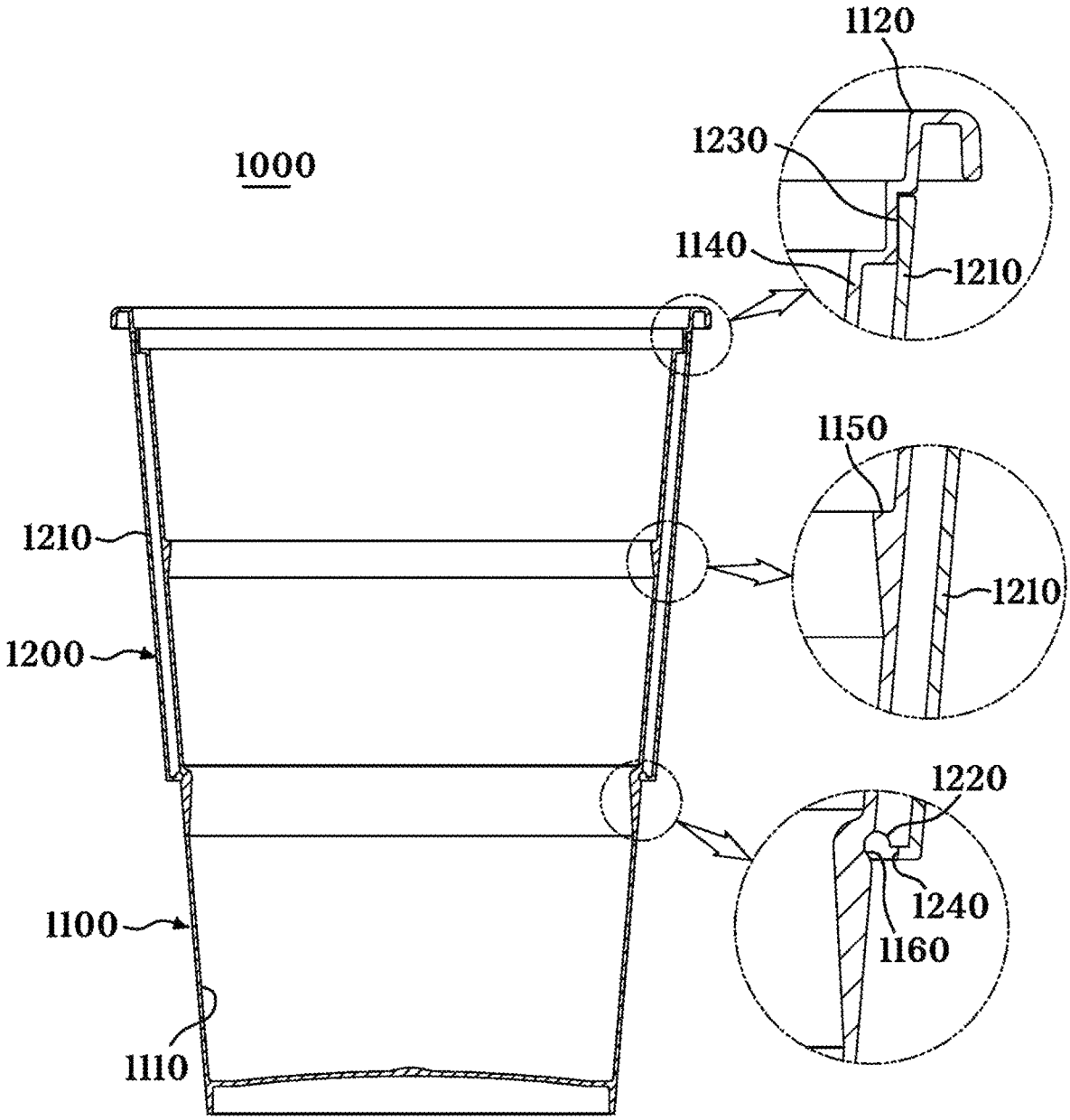
FIG. 3 is a cross-sectional view taken along line A-A in FIG. 2.
Figure 4:
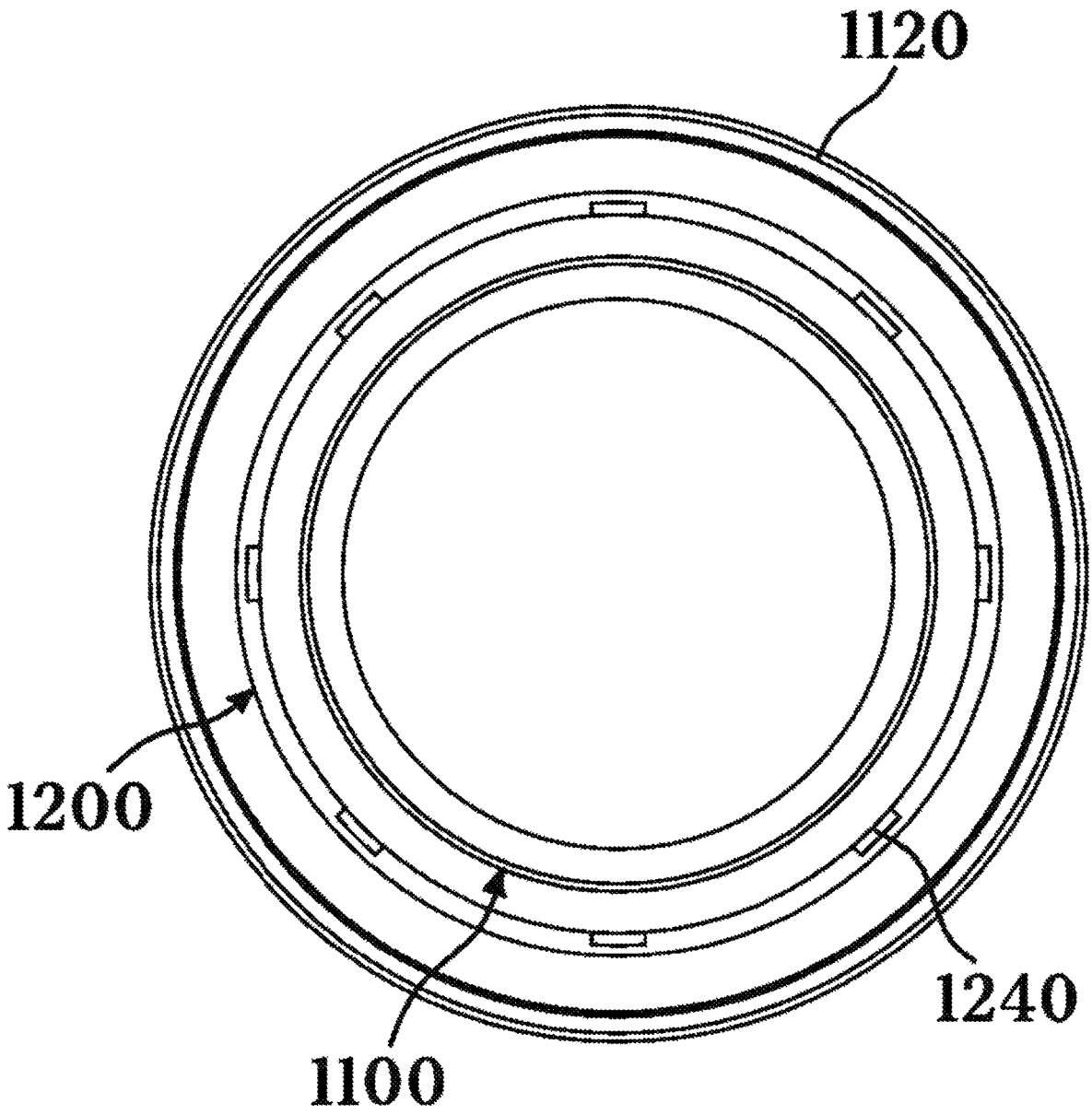
FIG. 4 is a bottom view of FIG. 1.
Figure 5:
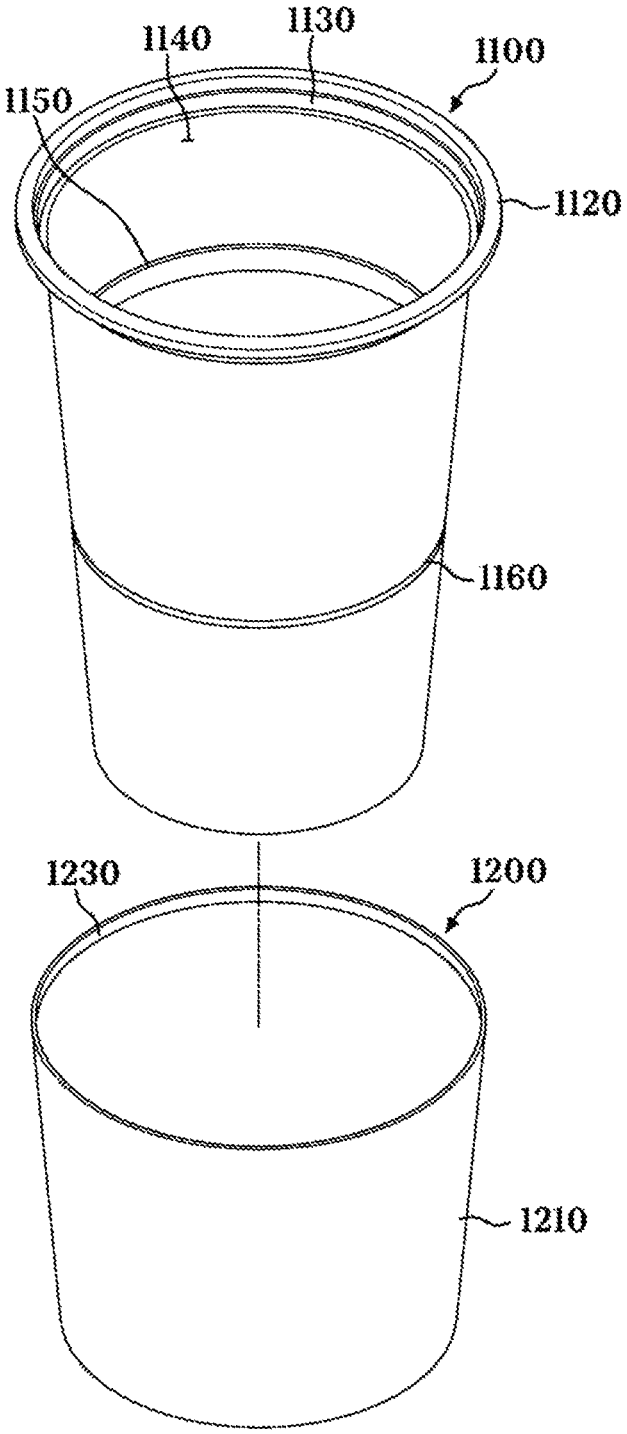
FIG. 5 is an exploded perspective view of FIG. 1.
Figure 6:
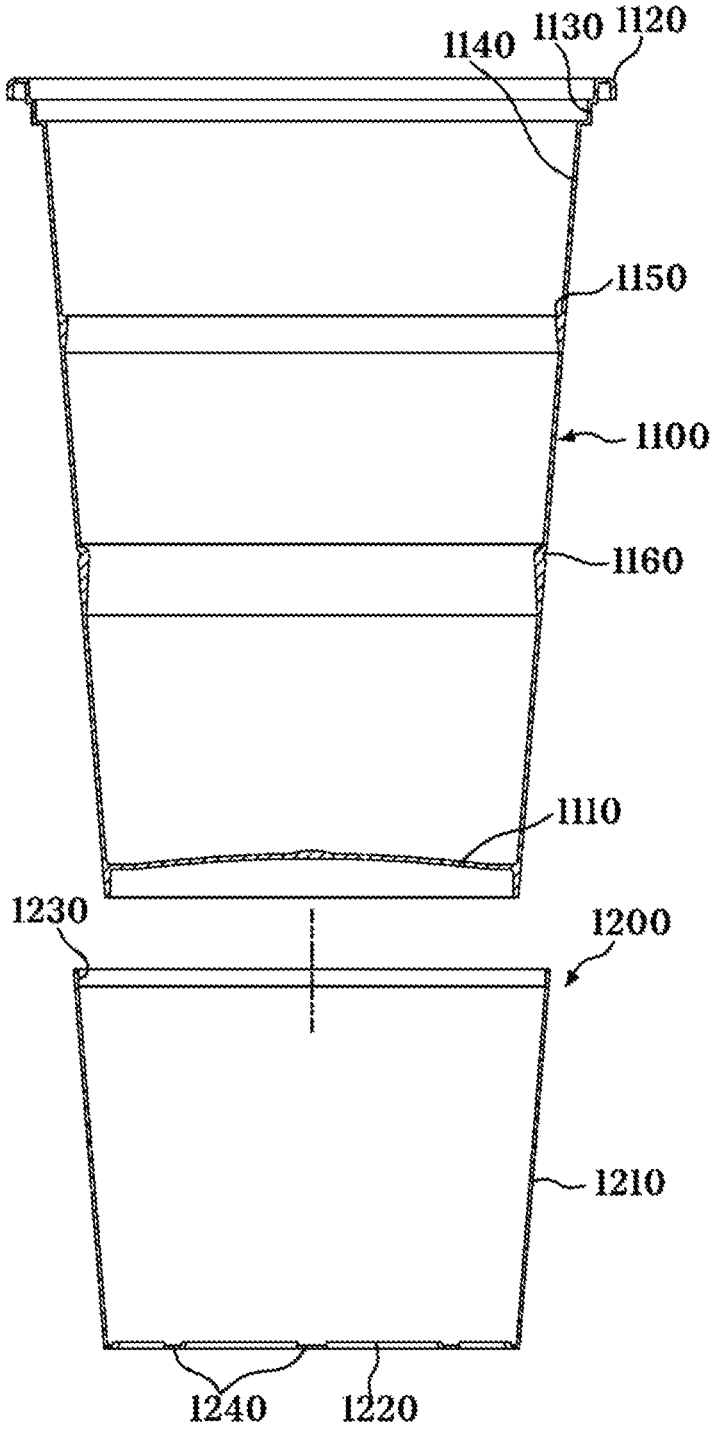
FIG. 6 is a vertical cross-sectional view of FIG. 5.

A loss of material is less in the cup shown in FIGS. 8 to 10 than the cup shown in FIG. 3.

According to the cup shown in FIG. 3, the anti-sticking protrusion is formed around the entire inner side with the outer side maintained at a predetermined angle in forming, so the loss of material is large.

According to the cup shown in FIGS. 8 to 10, the anti-sticking protrusions are formed at predetermined positions with regular angular intervals around the inner side of the containing part, so the loss of material is small. Accordingly, the manufacturing cost is relatively small and contraction does not occur during forming, so it is easy to form the product and the quality of the product is improved.

Further, according to the second embodiment, a cup holder bottom seat 2160 is formed at the lower portion of the cup body 2100 to support the bottom of the cup holder 2200, but the cup holder bottom seat 2160 may be formed very small such that the thickness of the cup body is little changed, or it may not be formed.

Accordingly, when the cup holder bottom seat 2160 of the cup body 2100 is formed very small such that the thickness of the cup body is little changed, the bottom of the cup holder 2200 can be firmly seated in the cup holder bottom seat 2160 of the cup body and the cup body does not contract during forming, whereby it is very easy to manufacture the product.

Even if the cup holder bottom seat 2160 is not formed on the cup body 2100, if the bottom of the cup holder 2200 is supported on the outer side of the cup body 2100, the cup body 2100 having the inclined fastening groove 2131 and the cup holder 2200 having the inclined fitting portion 2240 are firmly combined, so there is no problem in use.

Obviously, the cup body does not contract during forming, so it is very easy to manufacture the product.

The cup holder 2200, as in the first embodiment, has a pipe-shaped grip 2210 having a predetermined length and being inclined such that the diameter decreases downward, and a bottom seating protrusion 2220 protruding inward from the lower end of the grip 2210 to be fitted in the cup holder bottom seat 2160 or on the outer side of the cup body 2100.

Accordingly, when the cup body 2100 having the inclined fastening groove 2131 and the cup holder 2200 having the inclined fitting portion 2240 are fitted to each other and the bottom seating protrusion 2220 of the cup holder 2200 is seated in the cup holder bottom seat 2160 of the cup body 2100, the cup holder is firmly fixed to the cup body.

Obviously, even if the cup holder bottom seat 2160 is not formed on the cup body 2100, the bottom seating protrusion 2220 is in close contact with the outer side of the cup body 2100, so both ends of the cup holder 2200 are firmly supported on the outer side of the cup body 2100 with a predetermined gap therebetween.

Meanwhile, in the second embodiment, similar to the first embodiment, air holes 2230 may be formed with regular angular intervals at the bottom seating protrusion 2220 of the cup holder 2200 so that external air flows between the outer side of the containing part 2110 of the cup body 2100 and the grip 2210 of the cup holder 2200.

Accordingly, coldness or heat that transfers to the outer side of the containing part 2110, depending on the beverage in the cup body 2100, is discharged downward from the cup body 2100 and the cup holder 2200 by the air holes 2230.

Therefore, even if a user keeps holding the cup 2000, transfer of the coldness and heat to the cup holder 2200 is delayed, so the user can easily drink the beverage.

Figure 11:
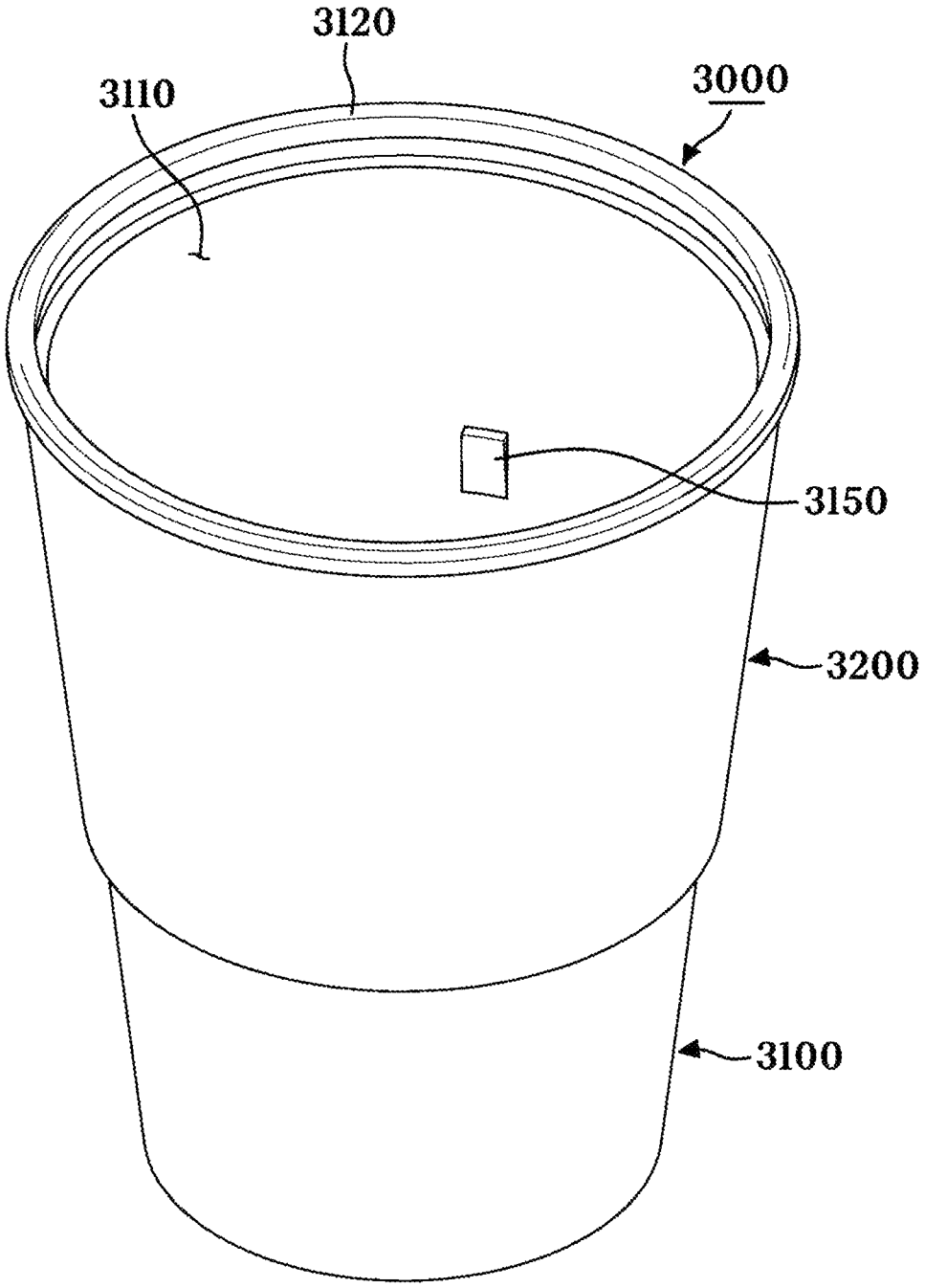
FIG. 11 is a perspective view showing a cup according to a third embodiment of the present invention.
Figure 12:
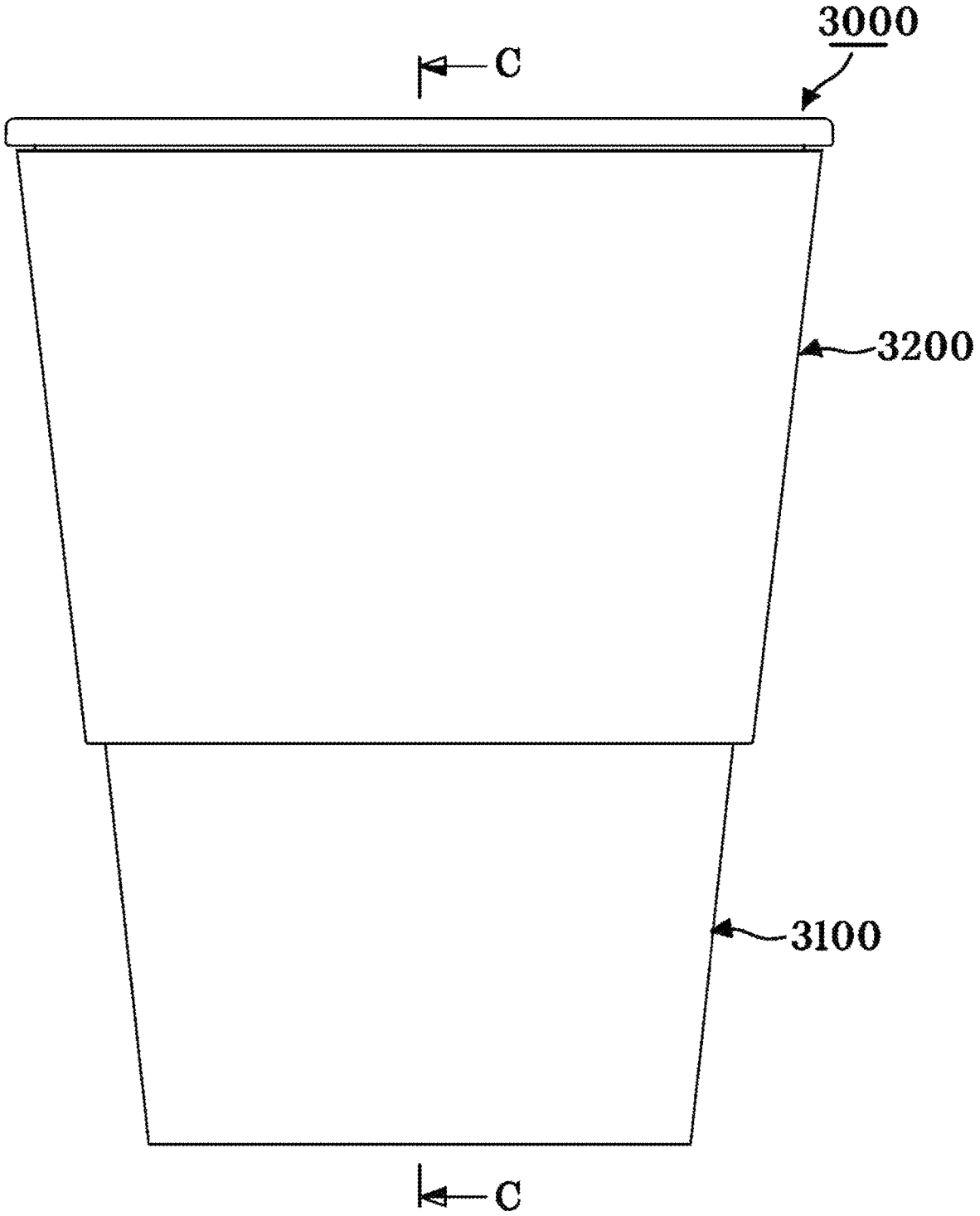
FIG. 12 is a front view of FIG. 11.
Figure 13:
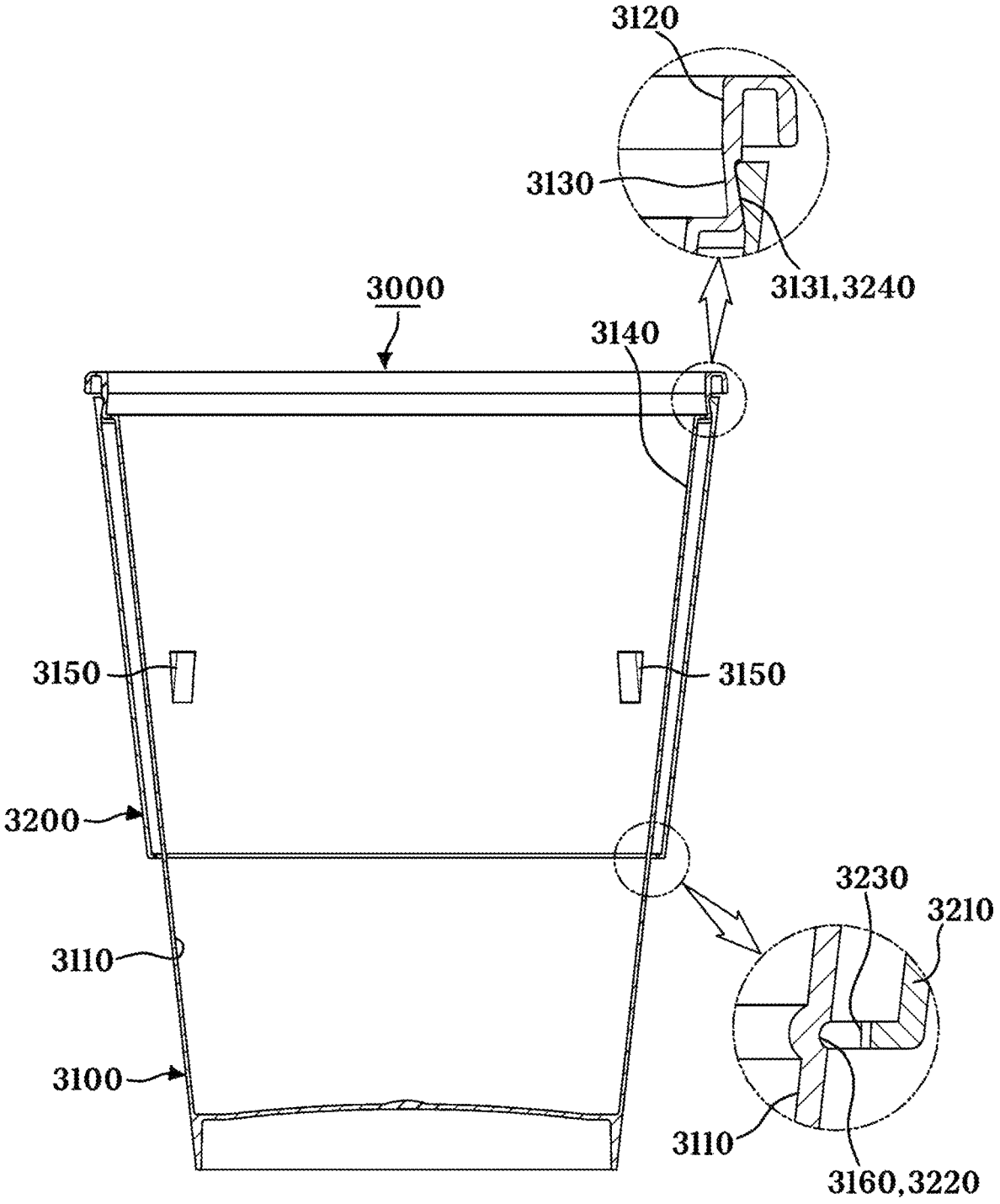
FIG. 13 is a cross-sectional view taken along line C-C in FIG. 12.

FIGS. 11 to 13 show a cup 3000 according to a third embodiment of the present invention.

A holder top seat 3130 is formed on the outer side of an opening 3120 of a cup body 3100 such that the upper portion of a cup holder 2200 is fitted thereon and an inclined fastening groove 3131 is formed on the holder top seat 3130 such that the diameter decreases upward.

An inclined fitting portion 3240 is formed at the upper portion of the cup holder 3200 such that the diameter of the inner side of the cup holder decreases upward to correspond to the inclined fastening groove 3131.

The holder top seat 3130 vertically extends upward from the inclined fastening groove 3131, whereby the opening 3120 is formed.

Accordingly, when the cup holder 3200 having the inclined fitting portion 3240 is fitted on the cup body 3100 having the inclined fastening groove 3131, the inclined fitting portion 3240 is seated in the inclined fastening groove 3131.

After assembly, the cup holder 3200 is not easily separated from the cup body 3100, so a user can easily use the cup.

Since the opening 3120 is formed by vertically extending the holder top seat 3130 from the inclined fastening groove 3131 of the cup body 3100, it is possible to adjust the diameter of the opening 3120 not to be large.

Anti-sticking protrusions 3150 are formed at predetermined positions with regular angular intervals of 120 degrees around the inner side of the cup body 3100 with the outer side of the cup body maintained at a predetermined angle. One, two, or four anti-sticking protrusion 3150 may be formed.

Accordingly, since the anti-sticking protrusion 3150 are formed with regular angular intervals of 120 degrees, a loss of material when the anti-sticking protrusions are formed at predetermined positions with regular angular intervals around the inner side of the containing part is smaller than that when the anti-sticking protrusions are formed around the entire inner side with the outer side of the cup body maintained at a predetermined angle during forming of the cup body 3100, so the manufacturing cost is reduced. Further, contraction does not occur during forming, so it is easy to form the product and the quality of the product is improved.

Further, according to the third embodiment, a cup holder bottom seat 3160 is formed at the lower portion of the cup body 3100 to support the bottom of the cup holder 3200, but the cup holder bottom seat 3160 may be formed very small such that the thickness of the cup body is little changed, or it may not be formed.

Accordingly, when the cup holder bottom seat 3160 is formed very small such that the thickness of the cup body 3160 is little changed, the bottom of the cup holder 3200 can be firmly seated in the cup holder bottom seat 3160 of and the cup body does not contract during forming, whereby it is very easy to manufacture the product. Further, even if the cup holder bottom seat 3160 is not formed on the cup body 3100, if the bottom of the cup holder 3200 is supported on the outer side of the cup body 3100, the cup body 3100 having the inclined fastening groove 3131 and the cup holder 3200 having the inclined fitting portion 3240 are firmly combined, so there is no problem in use and it is very easy to manufacture the product because the cup body does not contract during forming.

The cup holder 3200 has a pipe-shaped grip 3210 having a predetermined length and being inclined such that the diameter decreases downward, and a bottom seating protrusion 3220 protruding inward from the lower end of the grip 3210 to be fitted in the cup holder bottom seat 3160 or on the outer side of the cup body 3100.

Accordingly, when the cup body 3100 having the inclined fastening groove 3131 and the cup holder 3200 having the inclined fitting portion 3240 are fitted to each other and the bottom seating protrusion 3220 is seated in the cup holder bottom seat 3160 of the cup body 3100, the cup holder is firmly fixed to the cup body. Obviously, even if the cup holder bottom seat 3160 is not formed on the cup body 3100, the bottom seating protrusion 3220 is in close contact with the outer side of the cup body 3100, so both ends of the cup holder 3200 are firmly supported on the outer side of the cup body 3100 with a predetermined gap therebetween.

Meanwhile, in the third embodiment, similar to the first and second embodiments, air holes 3230 may be formed with regular angular intervals at the bottom seating protrusion 3220 of the cup holder 3200 so that external air flow between the outer side of the containing part 3100 having the containing part-inclined surface 3140 of the cup body 3100 and the grip 3210 of the cup holder 3200.

Accordingly, coldness or heat that transfers to the outer side of the containing part 3110, depending on the beverage in the cup body 3100, is discharged downward from the cup body 3100 and the cup holder 3200 by the air holes 3230, so even if a user keeps holding the cup 3000, transfer of the coldness and heat to the cup holder 3200 is delayed and the user can easily drink the beverage.

The embodiments described above and shown in the drawings should not be construed as limiting the spirit of the present invention. The protective range of the present invention is limited only by the claims and the present invention may be changed and modified in various ways by those skilled in the art. Accordingly, if the changes and modifications are apparent to those skilled in the art, they will be included in the protective range of the present invention.

DESCRIPTION OF THE REFERENCE NUMERALS IN THE DRAWINGS

1000, 2000, 3000: Cup
1100, 2100, 3100: Cup body
1110, 2110, 3110: Containing part
1120, 2120, 3120: Opening
1130, 2130, 3130: Holder top seat
2131, 3131: Inclined fastening groove
1140, 2140, 3140: Containing part-inclined surface
1150, 2150, 3150: Anti-sticking protrusion
1160, 2160, 3160: Cup holder bottom seat
1200, 2200, 3200: Cup holder
1210, 2210, 3210: Grip
1220, 2220, 3220: Bottom seating protrusion
1230: Vertical inner wall portion
1240, 2230, 3230: Air hole
2240, 3240: Inclined fitting portion

The invention claimed is:

1. A cup comprising:

a cup body made of synthetic resin and having a containing part with an opening being open upward and having a relatively large diameter to be able to receive a beverage or food; and a cup holder made of synthetic resin and fitted on the cup body from an end opposite the opening of the cup body, with a portion except for an upper end and a lower end thereof spaced a predetermined gap from an outer side of a containing part of the cup body, wherein the cup body has:

a holder top seat extending downward a predetermined length from the opening and stepped such that a diameter thereof decreases downward, and having an inclined fastening groove having a diameter decreasing upward, on an outer side thereof;

a containing part-inclined surface extending downward from the holder top seat such that a diameter thereof decreases downward, having a containing part for receiving a beverage or food, and having an outer side inclined at a predetermined angle from an upper portion integrally extending from the holder top seat and a lower end forming the containing part; and three or more anti-sticking protrusions formed with regular angular intervals around an inner side of the containing part at a predetermined distance from the opening of the cup body toward a bottom of the containing part, with the outer side forming the containing part of the cup body maintained at a predetermined angle, in order to support a bottom of a second cup holder inserted in the containing part of the subject cup body when a second cup composed of the second cup holder and a second cup body is stacked, and the cup holder has:

a pipe-shaped grip inclined with a predetermined length such that a diameter thereof decreases downward, and having an inclined fitting portion formed such that a diameter of an inner side of the cup holder decreases upward to correspond to the inclined fastening groove formed on the outer side of the holder top seat of the cup and to be in close contact with the inclined fastening groove; and a bottom seating protrusion protruding inward from a lower end of the grip of the cup holder to be in close contact with a lower portion of the cup body and having air holes formed with regular angular intervals so that external air flows between the outer side of the containing part of the cup and the grip of the cup holder.

2. The cup of claim 1, wherein the opening of the cup body is formed to be able to receive a beverage or food and is stepped with a predetermined length from an upper end thereof toward the holder top seat such that the stepped portion decreases in diameter at a lower portion thereof, wherein a portion extending from the opening of the cup body to the holder top seat is stepped in two steps.

3. The cup of claim 1, wherein a cup holder bottom seat is recessed inward at a predetermined position on the containing part-inclined surface of the cup such that the bottom seating protrusion at a lower portion of the cup holder is seated in close contact with the cup holder bottom seat.

* * * * *